US009876278B2

(12) United States Patent
Sawa

(10) Patent No.: US 9,876,278 B2
(45) Date of Patent: Jan. 23, 2018

(54) ANTENNA BOARD

(71) Applicant: KYOCERA Corporation, Kyoto-shi, Kyoto (JP)

(72) Inventor: Yoshinobu Sawa, Kyoto (JP)

(73) Assignee: KYOCERA Corporation, Kyoto-Shi, Kyoto (JP)

( * ) Notice: Subject to any disclaimer, the term of this patent is extended or adjusted under 35 U.S.C. 154(b) by 130 days.

(21) Appl. No.: 15/132,633

(22) Filed: Apr. 19, 2016

(65) Prior Publication Data

US 2016/0315397 A1 Oct. 27, 2016

(30) Foreign Application Priority Data

Apr. 21, 2015 (JP) ..... 2015-086691
Feb. 15, 2016 (JP) ..... 2016-025561

(51) Int. Cl.
*H01Q 1/38* (2006.01)
*H01Q 9/04* (2006.01)
*H01Q 5/385* (2015.01)

(52) U.S. Cl.
CPC ..... *H01Q 1/38* (2013.01); *H01Q 5/385* (2015.01); *H01Q 9/0414* (2013.01)

(58) Field of Classification Search
CPC ..... H01Q 1/38; H01Q 5/358; H01Q 9/0414
USPC ..... 343/700 MS
See application file for complete search history.

(56) References Cited

U.S. PATENT DOCUMENTS 5,438,697 A * 8/1995 Fowler ..... H01Q 9/0407 333/204
5,898,403 A * 4/1999 Saitoh ..... H01Q 1/38 333/185
6,795,021 B2 * 9/2004 Ngai ..... H01Q 1/523 343/700 MS
2015/0207233 A1 * 7/2015 Kim ..... H01Q 9/0485 343/785
2015/0236425 A1 * 8/2015 Sudo ..... H01Q 9/42 343/700 MS

FOREIGN PATENT DOCUMENTS

JP 05-145327 A 6/1993
JP 2015-092653 A 5/2015

* cited by examiner

*Primary Examiner* — Huedung Mancuso
(74) *Attorney, Agent, or Firm* — Volpe and Koenig, P.C.

(57) ABSTRACT

An antenna board includes a first dielectric layer, a strip conductor, a ground conductor layer, a second dielectric layer, a first patch conductor, a third dielectric layer, a second patch conductor, a through conductor, and a waveguide including upper and lower ground conductors and a ground through conductor. The upper and lower ground conductors are disposed so as to hold therebetween at least one of the first, second, and third dielectric layers. The ground through conductor is disposed in such a manner that at least one lies on each of both sides in a direction orthogonal to an extending direction of the strip conductor, and extends through the dielectric layers lying between the upper and lower ground conductors.

10 Claims, 5 Drawing Sheets

ANTENNA BOARD

BACKGROUND OF THE INVENTION

1. Field of the Invention

An embodiment of the present invention relates to an antenna board obtainable by laminating dielectric layers and conductor layers into a multilayer.

2. Description of Related Art

Frequency bands used for wireless personal area networks differ from country to country. It is therefore necessary to widen antenna frequency bands in order to use an antenna board in different countries. This type of antenna board is disclosed in, for example, Japanese Unexamined Patent Publication No. HEI 5-145327. In recent years there has been a demand for an antenna board having a still wider frequency band (57-66 GHz) as an antenna board usable all over the world.

SUMMARY OF THE INVENTION

It is an object of an embodiment of the present invention to provide a wide band antenna board that is rich in directionality for transmitting and receiving signals in a wide frequency band of, for example, 57-66 GHz.

The antenna board according to the embodiment of the present invention includes a first dielectric layer, a strip conductor, a ground conductor layer, a second dielectric layer, a first patch conductor, a third dielectric layer, a second patch conductor, a through conductor, and a waveguide. The strip conductor is disposed on an upper surface of the first dielectric layer, extends in one direction from a peripheral part of the first dielectric layer, and has a terminal portion. The ground conductor layer is disposed on a lower surface of the first dielectric layer. The second dielectric layer is laminated on the upper surface of the first dielectric layer and an upper surface of the strip conductor. The first patch conductor is disposed on an upper surface of the second dielectric layer so as to overlie a location of the terminal portion. The third dielectric layer is laminated on the second dielectric layer and the first patch conductor. The second patch conductor is electrically independent and disposed on an upper surface of the third dielectric layer. The second patch conductor at least partially overlies a location at which the first patch conductor is disposed. A center of the second patch conductor is deviated from a center of the first patch conductor in an extending direction of the strip conductor. The through conductor extends through the second dielectric layer and connects the terminal portion and the first patch conductor. The waveguide includes upper and lower ground conductors and a ground through conductor, and is disposed in a region closer to the extending direction of the strip conductor than the first and second patch conductors. The upper and lower ground conductors are disposed so as to hold therebetween at least one of the first, second, and third dielectric layers. The ground through conductor is disposed in such a manner that at least one lies on each of both sides in a direction orthogonal to the extending direction of the strip conductor and extends through the dielectric layers lying between the upper and lower ground conductors.

DESCRIPTION OF THE EMBODIMENTS

Figure 1A:
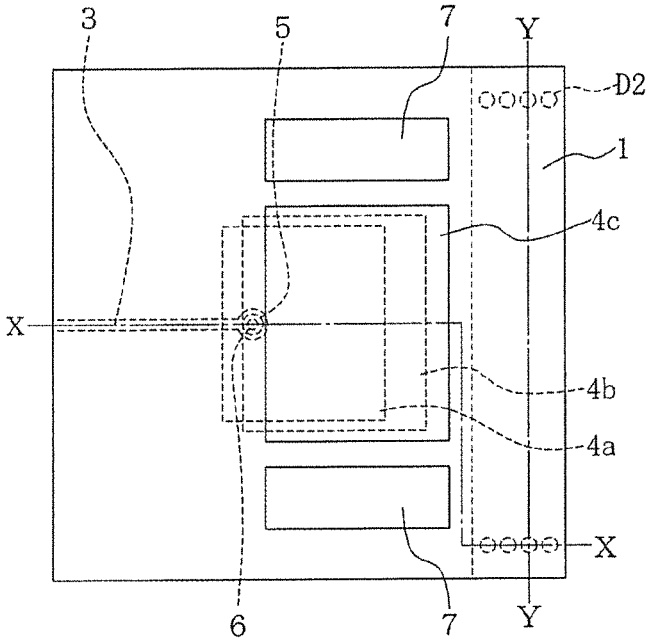
FIG. 1A is a top view showing an antenna board according to a first embodiment of the present invention.
Figure 1B:
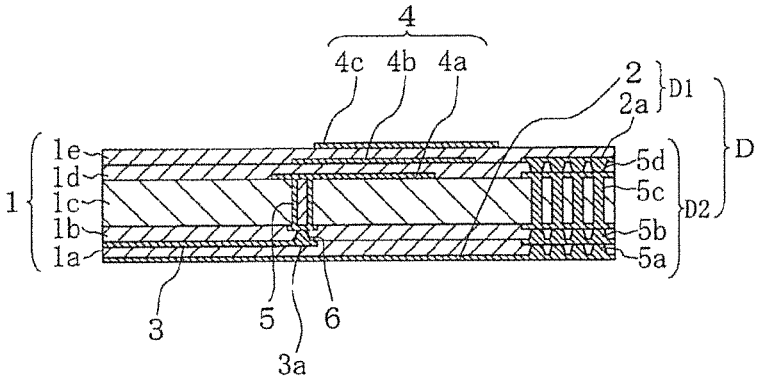
FIG. 1B is a sectional view taken along line X-X in FIG. 1A.
Figure 1C:
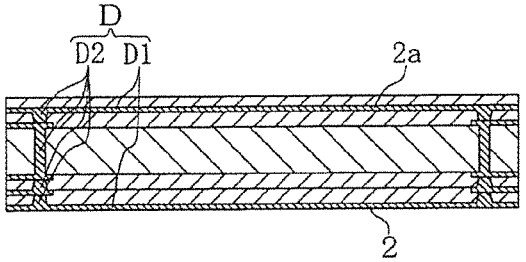
FIG. 1C is a sectional view taken along line Y-Y in FIG. 1A.

An antenna board according to a first embodiment of the present invention is described with reference to FIGS. 1A to 1C. FIG. 1B is a sectional view taken along line X-X in FIG. 1A. FIG. 1C is a sectional view taken along line Y-Y in FIG. 1A. As shown in FIGS. 1A to 1C, the antenna board of the first embodiment includes a dielectric board 1 having thereon a plurality of dielectric layers 1*a* to 1*e* laminated one upon another, a ground conductor layer 2 for shielding, a strip conductor 3 for inputting and outputting high frequency signals, a patch conductor 4 for transmitting and receiving electromagnetic waves, an auxiliary patch conductor 7, and a waveguide D.

The dielectric layers 1*a* to 1*e* are composed of, for example, a resin-based dielectric material made of glass cloth impregnated with a thermosetting resin, such as an epoxy resin, a bismaleimide triazine resin, and an acrylic modified polyphenylene ether resin. The dielectric layers 1*a* to 1*e* respectively have a thickness of approximately 30-100 μm. The dielectric layers 1*a* to 1*e* have a dielectric constant of approximately 3-5. The dielectric layers 1*a* to 1*e* are made up of the first dielectric layer 1*a*, the intermediate dielectric layer 1*b*, the second dielectric layer 1*c*, the third dielectric layer 1*d*, and the fourth dielectric layer 1*e*.

The ground conductor layer 2 is deposited over the entire lower surface of the lowermost dielectric layer 1*a*. The ground conductor layer 2 functions as a shield. The ground conductor layer 2 has a thickness of approximately 5-20 μm. The ground conductor layer 2 is composed of, for example, copper.

The strip conductor 3 is opposed to the ground conductor layer 2 with the first dielectric layer 1*a* interposed therebetween, and is disposed between the first dielectric layer 1*a* and the intermediate dielectric layer 1*b*. The strip conductor 3 is a narrow strip-shaped conductor having a terminal portion 3*a* in a middle part of the dielectric board 1, and extends inside the dielectric board 1 in one direction (hereinafter referred to as "extending direction") toward the terminal portion 3*a*. In the antenna board of the first embodiment, the strip conductor 3 functions as a transmission line, through which a high frequency signal is inputted and outputted, and the high frequency signal is to be transmitted to the strip conductor 3. The strip conductor 3 has a width of approximately 50-350 μm. The strip conductor 3 has a thickness of approximately 5-20 μm. The strip conductor 3 is composed of, for example, copper.

The patch conductor 4 is made up of a first patch conductor 4*a*, a second patch conductor 4*b*, and a third patch conductor 4*c*. These patch conductors 4*a* to 4*c* are electrically independent of one another. The patch conductors 4*a* to 4*c* have a square shape that has sides parallel to the extending direction of the strip conductor 3 (hereinafter referred to as "longitudinal sides") and sides parallel in a direction perpendicular to the extending direction (hereinafter referred to as "lateral sides"). The sides of each of the patch conductors 4*a* to 4*c* respectively have a length of approximately 0.5-5 mm. The patch conductors 4*a* to 4*c* respectively have a thickness of approximately 5-20 μm. The patch conductors 4*a* to 4*c* are composed of, for example, copper.

The first patch conductor 4*a* is disposed between the second dielectric layer 1*c* and the third dielectric layer 1*d* so as to overlie a location above the terminal portion 3*a* of the strip conductor 3. Therefore, the intermediate dielectric layer 1*b* and the second dielectric layer 1*c* are interposed between the first patch conductor 4*a* and the strip conductor 3. The first patch conductor 4*a* is connected to the terminal portion 3*a* of the strip conductor 3 by interposing therebetween a through conductor 5 extending through the second dielectric layer 1*c*, and a through conductor 6 extending through the intermediate dielectric layer 1*b*. The through conductor 5 has a cylindrical shape with a diameter of approximately 50-200 μm and a thickness of approximately 5-20 μm. The through conductor 6 has a columnar shape or circular truncated cone shape with a diameter of approximately 30-100 μm. The through conductors 5 and 6 are respectively composed of, for example, copper. The first patch conductor 4*a* radiates an electromagnetic wave to the outside upon receipt of supply of a high frequency signal from the strip conductor 3. Alternatively, the first patch conductor 4*a* causes the strip conductor 3 to generate a high frequency signal upon receipt of an electromagnetic wave from the outside.

The second patch conductor 4*b* is disposed between the third dielectric layer 1*d* and the fourth dielectric layer 1*e* so as to at least partially overlie a location above the first patch conductor 4*a*. The second patch conductor 4*b* is consequently subjected to electrostatic capacity coupling to the first patch conductor 4*a* with the third dielectric layer 1*d* interposed therebetween. A center of the second patch conductor 4*b* is deviated from a center of the first patch conductor 4*a* in the extending direction of the strip conductor 3. The center of the patch conductor denotes an intersection of two diagonals when the patch conductor has the square shape. The deviation of the second patch conductor 4*b* reaches such a degree that the second patch conductor 4*b* overlies an area of 80% or more of the location at which the first patch conductor 4*a* is disposed. Upon receipt of the electromagnetic wave from the first patch conductor 4*a*, the second patch conductor 4*b* radiates an electromagnetic wave corresponding thereto to the outside. Alternatively, upon receipt of the electromagnetic wave from the outside, the second patch conductor 4*b* supplies an electromagnetic wave corresponding thereto to the first patch conductor 4*a*. The second patch conductor 4*b* has sides that are preferably approximately 0.05-0.5 mm larger than those of the first patch conductor 4*a*.

The third patch conductor 4*c* is disposed on an upper surface of the uppermost fourth dielectric layer 1*e* so as to at least partially overlie a location above the second patch conductor 4*b*. The third patch conductor 4*c* is consequently subjected to electrostatic capacity coupling to the second patch conductor 4*b* with the fourth dielectric layer 1*e* interposed therebetween. The third patch conductor 4*c* is disposed with a deviation from the second patch conductor 4*b* in the extending direction of the strip conductor 3. The deviation of the third patch conductor 4*c* reaches such a degree that the third patch conductor 4*c* overlies an area of 80% or more of a location at which the second patch conductor 4*b* is disposed. Upon receipt of the electromagnetic wave from the second patch conductor 4*b*, the third patch conductor 4*c* radiates an electromagnetic wave corresponding thereto to the outside. Alternatively, upon receipt of the electromagnetic wave from the outside, the third patch conductor 4*c* supplies an electromagnetic wave corresponding thereto to the second patch conductor 4*b*. The third patch conductor 4*c* has sides that are preferably approximately 0.05-0.5 mm larger than those of the second patch conductor 4*b*.

In particular, a wider frequency band of high frequency signals is ensured by disposing so that the second patch conductor 4*b* overlies the area of 80% or more of the location at which the first patch conductor 4*a* is disposed, and the third patch conductor 4*c* overlies the area of 80% or more of the location at which the second patch conductor 4*b* is disposed.

The auxiliary patch conductors 7 are disposed on an upper surface of the fourth dielectric layer 1*e* so as not to overlie the locations at which the first patch conductor 4*a* and the second patch conductor 4*b* are respectively disposed, on both sides in a direction orthogonal to the extending direction of the strip conductor 3 on the third patch conductor 4*c*. The auxiliary patch conductors 7 are electrically independent of one another. The auxiliary patch conductors 7 have a square shape that has sides parallel to the extending direction of the strip conductor 3 (hereinafter referred to as "longitudinal sides") and sides parallel in the direction perpendicular to the extending direction of the strip conductor 3 (hereinafter referred to as "lateral sides"). The sides of the auxiliary patch conductors 7 respectively have a length of approximately 0.5-5 mm. The auxiliary patch conductors 7 respectively have a thickness of approximately 5-20 μm. The auxiliary patch conductors 7 are composed of, for example, copper. The auxiliary patch conductors 7 are respectively spaced approximately 0.1-1 mm from the longitudinal sides of the third patch conductor 4*c*.

Thus, the center of the second patch conductor 4*b* is deviated from the center of the first patch conductor 4*a* in the extending direction of the strip conductor 3, and the center of the third patch conductor 4*c* is deviated from the center of the second patch conductor 4*b* in the extending direction of the strip conductor 3. Therefore, for example, when an electromagnetic wave corresponding to a high frequency signal is radiated through the patch conductors 4*a* to 4*c*, the electromagnetic wave is radiated so that the electromagnetic wave sequentially expands from the underlying patch conductor 4*a* and along peripheral edges of the overlying patch conductors 4*b* and 4*c*. Consequently, a composite resonance due to the deviations occurs and is then radiated. Further, a composite resonance occurs between the third patch conductor 4*c* and the auxiliary patch conductors 7 and through end portions of the auxiliary patch conductors 7, and the composite resonance is then radiated. This leads to a wide frequency band of high frequency signals to be radiated through the first to third patch conductors 4*a* to 4*c* and the auxiliary patch conductors 7.

The waveguide D is made up of the upper and lower ground conductor layers D1 disposed in a region closer to the extending direction of the strip conductor 3 than the patch conductor 4, and the ground through conductors D2.

In the first embodiment, the upper and lower ground conductor layers D1 are made up of, for example, the ground conductor layer 2 disposed on the lower surface of the lowermost first dielectric layer 1*a*, and the ground conductor 2*a* disposed on the upper surface of the third dielectric layer 1*d*. The upper and lower ground conductor layers D1 respectively have a thickness of approximately 5-20 μm. The upper and lower ground conductor layers D1 are composed of, for example, copper.

In the first embodiment, the ground through conductors D2 are made up of a plurality of through conductors 5*a* to 5*d* that respectively coaxially extend through the dielectric layers 1*a* to 1*d* interposed between the upper and lower ground conductors D1. The through conductor 5*a* is connected to the ground conductor layer 2, and the through conductor 5*d* is connected to the ground conductor 2*a*. The ground through conductors D2 are serially disposed along the extending direction of the strip conductor 3 on each of both sides in the direction orthogonal to the extending direction of the strip conductor 3. The through conductors 5*a*, 5*b*, and 5*d* have a columnar shape or circular truncated cone shape with a diameter of approximately 30-100 μm. The through conductor 5*c* has a columnar shape with a diameter of approximately 50-200 μm. The ground through conductors D2 are composed of, for example, copper.

The ground through conductors D2 are preferably respectively disposed closer to the periphery than the right and left auxiliary patch conductors 7 on at least the patch conductor 4. This configuration contributes to further enhancing electromagnetic waves to be propagated from the patch conductor 4 and the auxiliary patch conductors 7 to the waveguide D.

Thus, with the antenna board according to the first embodiment, the waveguide D made up of the upper and lower ground conductor layers D1 and the ground through conductors D2 is disposed in the region closer to the extending direction of the strip conductor 3 than the patch conductor 4 and the auxiliary patch conductors 7. Therefore, part of electromagnetic waves corresponding to high frequency signals to be radiated from the third patch conductor 4 and the auxiliary patch conductors 7 is also to be radiated in the extending direction of the strip conductor 3 through the waveguide D. This makes it possible to transmit and receive the signals in the extending direction of the strip conductor 3 in addition to an upward direction with respect to the third patch conductor 4 and the auxiliary patch conductors 7. It is consequently possible to provide a wide-band antenna board that is rich in transmitting and receiving directions of signals in a wide frequency band of, for example 57-66 GHz.

Figure 2A:
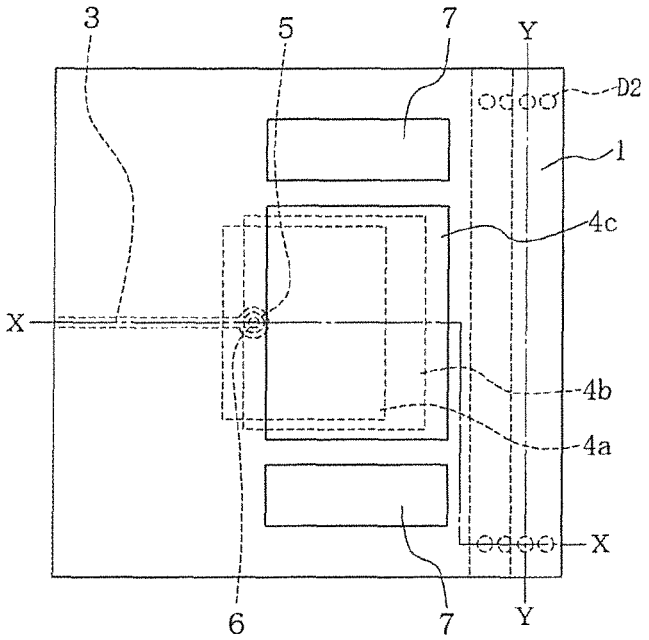
FIG. 2A is a top view showing an antenna board according to a second embodiment of the present invention.
Figure 2B:
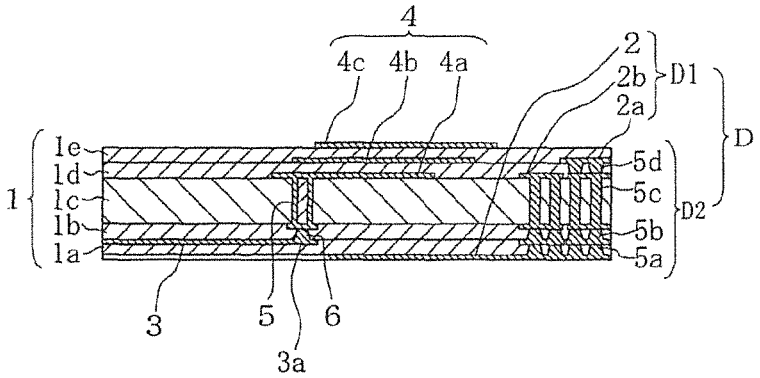
FIG. 2B is a sectional view taken along line X-X in FIG. 2A.
Figure 2C:
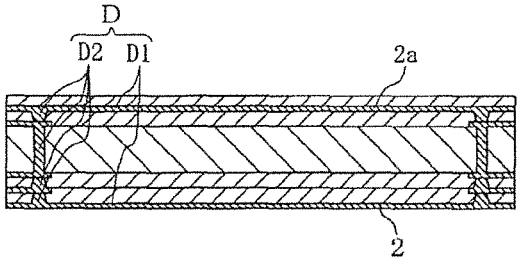
FIG. 2C is a sectional view taken along line Y-Y in FIG. 2A.

An antenna board according to a second embodiment is described below. In the antenna board of the first embodiment, the upper and lower ground conductor layers D1 are respectively disposed on the first dielectric layer 1*a* and the third dielectric layer 1*d*. In the antenna board of the second embodiment, for example, the upper and lower ground conductor layers D1 are respectively disposed on the lower surface of the first dielectric layer 1*a* and the upper surface of the second dielectric layer 1*c* and the upper surface of the third dielectric layer 1*d* as shown in FIGS. 2A to 2C. That is, in the antenna board of the second embodiment, as shown in FIG. 2B, the ground conductor layer 2 is disposed on the lower surface of the first dielectric layer 1*a*, the ground conductor 2*b* is disposed on the upper surface of the second dielectric layer 1*c*, and the ground conductor 2*a* is disposed on the upper surface of the third dielectric layer 1*d*.

Antenna boards respectively according to third and fourth embodiments are described below. In the antenna board of the first embodiment, the ground through conductors D2 are disposed serially (namely, in two rows) along the extending direction of the strip conductor 3 on both sides in the direction orthogonal to the extending direction of the strip conductor 3. In the antenna boards of the third and fourth embodiments, some of the ground through conductors D2 are disposed with a deviation from other ground through conductors D2 disposed serially along the extending direction of the strip conductor 3 as shown in FIGS. 3A and 4A.

Figure 3A:
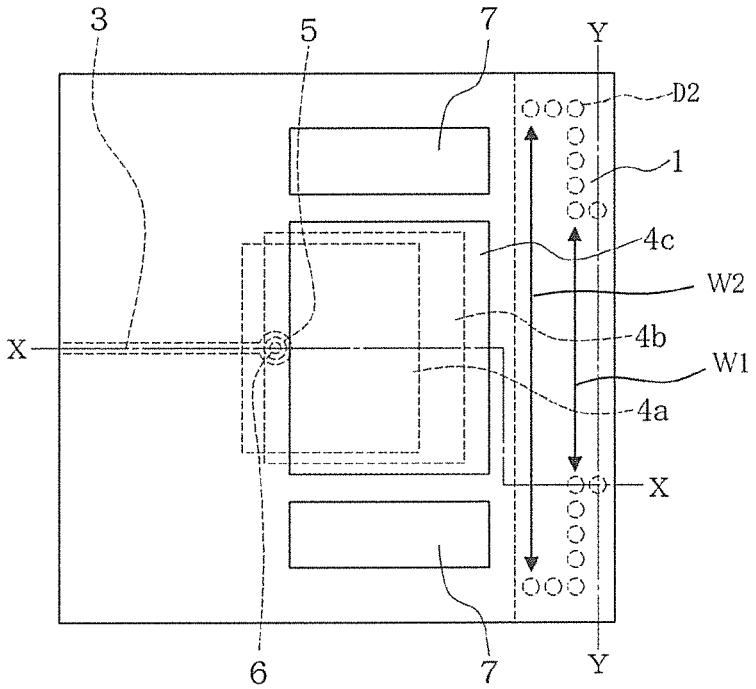
FIG. 3A is a top view showing an antenna board according to a third embodiment of the present invention.
Figure 3B:
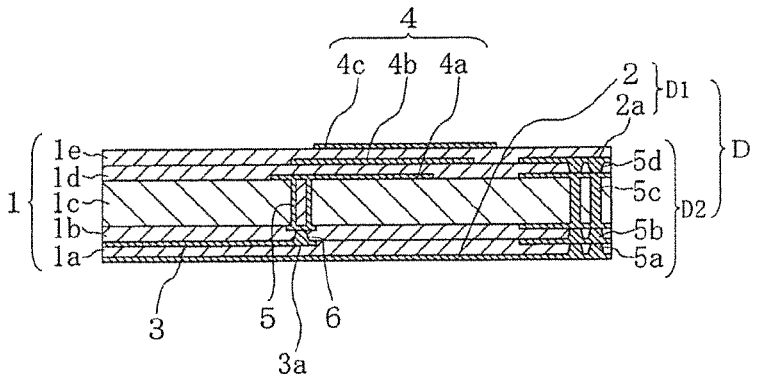
FIG. 3B is a sectional view taken along line X-X in FIG. 3A.
Figure 3C:
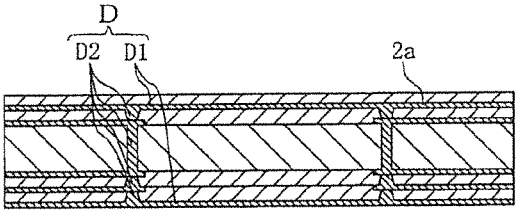
FIG. 3C is a sectional view taken along line Y-Y in FIG. 3A.
Figure 4A:
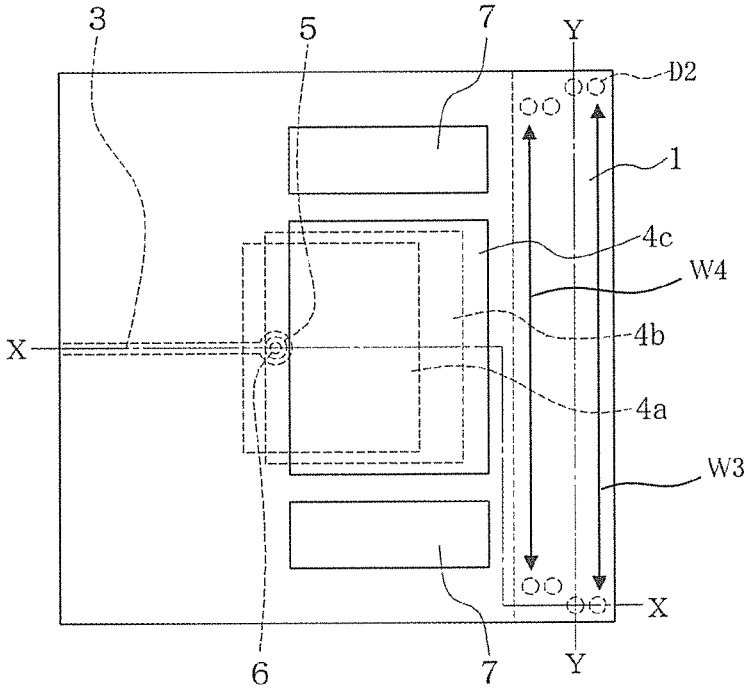
FIG. 4A is a top view showing an antenna board according to a fourth embodiment of the present invention.
Figure 4B:
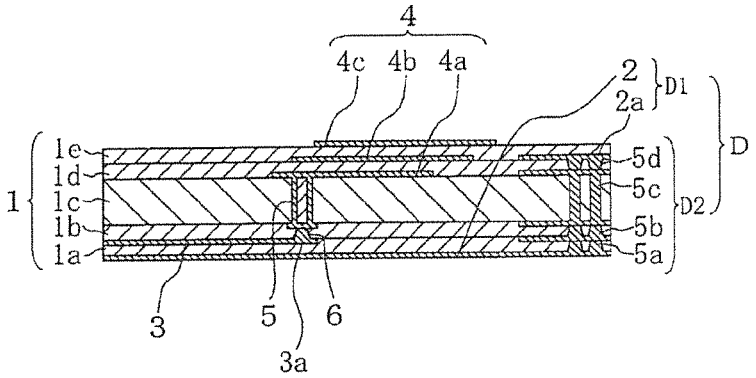
FIG. 4B is a sectional view taken along line X-X in FIG. 4A.
Figure 4C:
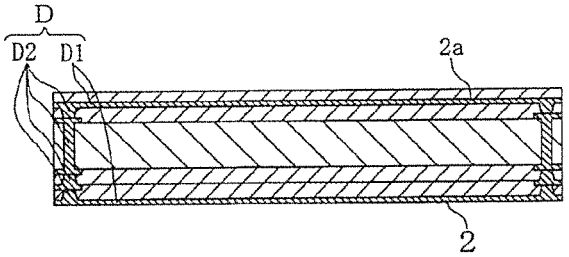
FIG. 4C is a sectional view taken along line Y-Y in FIG. 4A.

In the antenna board of the third embodiment, a distance W1 between the rows of the ground through conductors D2 close to the periphery is smaller than a distance W2 between the rows of the ground through conductors D2 close to the patch conductor as shown in FIGS. 3A to 3C. In the antenna board of the fourth embodiment, a distance W3 between the rows of the ground through conductors D2 close to the periphery is larger than a distance W4 between the rows of the ground through conductors D2 close to the patch conductor as shown in FIGS. 4A to 4C.

The antenna board capable of efficiently transmitting and receiving signals according to the frequency of high frequency signals is providable by so disposing the waveguide D including the upper and lower ground conductor layers D1 and the ground through conductors D2.

Figure 5A:
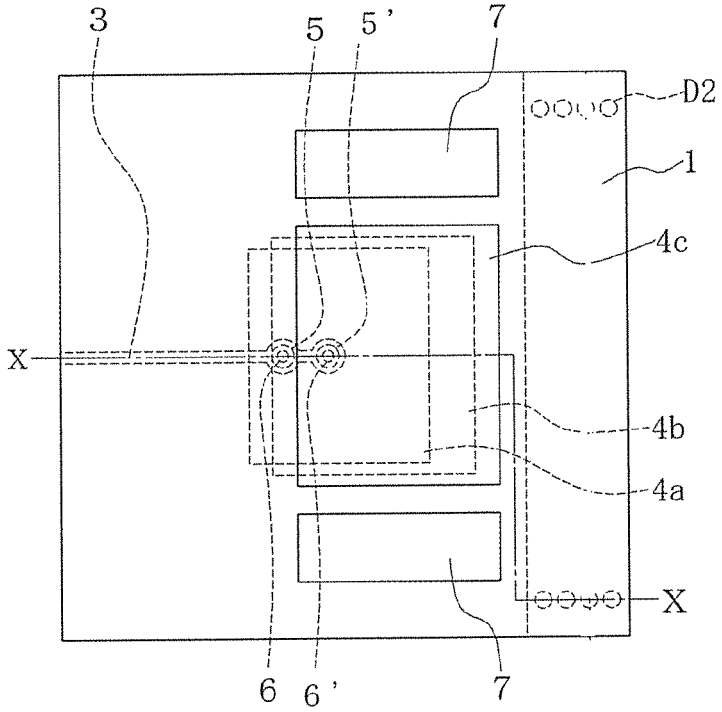
FIG. 5A is a top view showing an antenna board according to a fifth embodiment of the present invention.
Figure 5B:
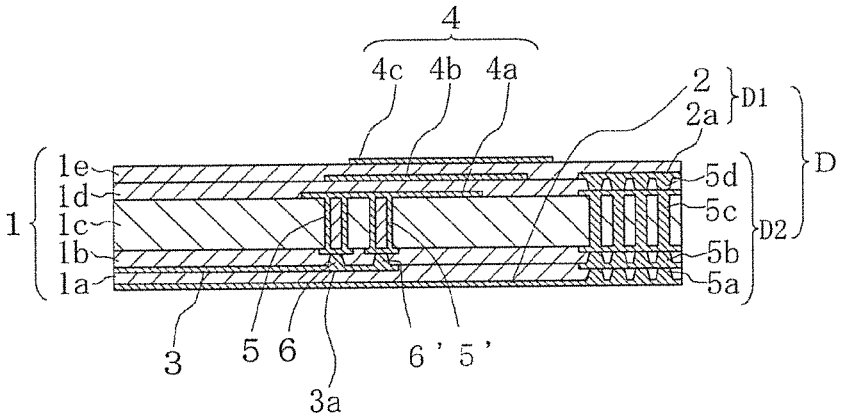
FIG. 5B is a sectional view taken along line X-X in FIG. 5A.

An antenna board according to a fifth embodiment is described below. In the antenna board of the first embodiment, the first patch conductor 4*a* and the terminal portion 3*a* of the strip conductor 3 are connected to each other by a pair of the through conductors 5 and 6. In the antenna board of the fifth embodiment, the first patch conductor 4*a* and the terminal portion 3*a* of the strip conductor 3 may be connected to each other by two pairs of the through conductors 5 and 6 and through conductors 5' and 6', which are disposed adjacent to each other along the extending direction of the strip conductor 3 as shown in FIGS. 5A and 5B. It is possible to generate a composite resonance by adjacently disposing the two pairs of through conductors 5 and 6 and through conductors 5' and 6' so as to ensure a capacity therebetween. This makes it possible to further widen the frequency band of high frequency signals.

The distance between the through conductors 5 and 6 and the through conductors 5' and 6' is preferably not more than half the wavelength of high frequency signals to be transmitted to the strip conductor 3. It is possible to generate a further composite resonance and further widen the frequency band of high frequency signals by setting the distance to not more than the half.

As described above, the antenna boards disclosed in the present application respectively have the waveguide in the region closer to the extending direction of the strip conductor than the first and second patch conductors. The waveguide includes the upper and lower ground conductors disposed so as to hold therebetween at least one of the first, second, and third dielectric layers, and the ground through conductors disposed in the manner that at least one lies on each of both sides in the direction orthogonal to the extending direction of the strip conductor and extends through the dielectric layers lying between the upper and lower ground conductors. Hence, part of electromagnetic waves corresponding to high frequency signals to be radiated from the second patch conductor is to be radiated through the waveguide in the extending direction of the strip conductor. This makes it possible to transmit and receive the signals also in the extending direction of the strip conductor in addition to the upward direction with respect to the second patch conductor. It is consequently possible to provide the wide-band antenna board that is rich in transmitting and receiving directions of signals in the wide frequency band of, for example 57-66 GHz.

It is to be understood that the present invention is not limited to the foregoing embodiments, and that various changes may be made so far as they do not deviate from the gist of the present invention. For example, though the patch conductors and the auxiliary patch conductors have the square shape in the antenna boards according to the first to firth embodiments, these patch conductors may have a different shape, such as a circular shape, and a polygonal shape other than the square shape.

What is claimed is:

1. An antenna board comprising:

a first dielectric layer;

a strip conductor that is disposed on an upper surface of the first dielectric layer, extends in one direction from a peripheral part of the first dielectric layer, and has a terminal portion;

a ground conductor layer disposed on a lower surface of the first dielectric layer;

a second dielectric layer laminated on the upper surface of the first dielectric layer and an upper surface of the strip conductor;

a first patch conductor disposed on an upper surface of the second dielectric layer so as to overlie a location of the terminal portion;

a third dielectric layer laminated on the second dielectric layer and the first patch conductor;

an electrically independent second patch conductor disposed on an upper surface of the third dielectric layer, the second patch conductor at least partially overlying a location at which the first patch conductor is disposed, a center of the second patch conductor being deviated from a center of the first patch conductor in an extending direction of the strip conductor;

a through conductor extending through the second dielectric layer and connecting the terminal portion and the first patch conductor; and a waveguide comprising upper and lower ground conductors and a ground through conductor, the wave guide being disposed in a region closer to the extending direction of the strip conductor than the first and second patch conductors, wherein the upper and lower ground conductors are disposed so as to hold therebetween at least one of the first, second, and third dielectric layers, and wherein the ground through conductor is disposed in such a manner that at least one lies on each of both sides in a direction orthogonal to the extending direction of the strip conductor and extends through the dielectric layers lying between the upper and lower ground conductors.

2. The antenna board according to claim 1, wherein a plurality of the ground through conductors are disposed on each of both sides in the direction orthogonal to the extending direction of the strip conductor, and are disposed serially along the extending direction of the strip conductor.

3. The antenna board according to claim 1, wherein a plurality of the ground through conductors are disposed on each of both sides in the direction orthogonal to the extending direction of the strip conductor, and some of the ground through conductors are disposed with a deviation from other ground through conductors serially disposed along the extending direction of the strip conductor.

4. The antenna board according to claim 1, wherein the second patch conductor is disposed so as to overlie an area of 80% or more of the location at which the first patch conductor is disposed.

5. The antenna board according to claim 1, further comprising, on an upper surface of the third dielectric layer, auxiliary patch conductors respectively disposed on both sides of the second patch conductor in the direction orthogonal to the extending direction of the strip conductor so as not to overlie a location at which the first and second patch conductor is disposed, the auxiliary patch conductors being electrically independent from the first and second patch conductors.

6. The antenna board according to claim 1, wherein the terminal portion and the first patch conductor are connected to each other by a plurality of the through conductors disposed adjacent to each other along the extending direction of the strip conductor.

7. The antenna board according to claim 6, wherein a distance between the through conductors is not more than half a wavelength of a high frequency signal to be transmitted to the strip conductor.

8. The antenna board according to claim 1, further comprising:

a fourth dielectric layer laminated on the third dielectric layer and the second patch conductor; and a third patch conductor disposed on an upper surface of the fourth dielectric layer so as to at least partially overlie the location at which the second patch conductor is disposed, the third patch conductor being electrically independent from the second patch conductor, wherein a center of the third patch conductor is deviated from a center of the second patch conductor in the extending direction of the strip conductor.

9. The antenna board according to claim 8, wherein the third patch conductor is disposed so as to overlie an area of 80% or more of the location at which the second patch conductor is disposed.

10. The antenna board according to claim 8, further comprising, on the upper surface of the fourth dielectric layer, auxiliary patch conductors respectively disposed on both sides of the third patch conductor in the direction orthogonal to the extending direction of the strip conductor so as not to overlie a location at which the third patch conductor is disposed, the auxiliary patch conductors being electrically independent from the first, second, and third patch conductors.

* * * * *